United States Patent [19]

Grabbe

[11] Patent Number: 4,895,521

[45] Date of Patent: Jan. 23, 1990

[54] MULTI-PORT COAXIAL CONNECTOR ASSEMBLY

[75] Inventor: Dimitry G. Grabbe, Middletown, Pa.

[73] Assignee: AMP Incorporated, Harrisburg, Pa.

[21] Appl. No.: 297,636

[22] Filed: Jan. 13, 1989

[51] Int. Cl.[4] ..... H01R 17/18

[52] U.S. Cl. ..... 439/63; 439/78; 439/581

[58] Field of Search ..... 439/63, 78, 82, 580, 439/581

[56] References Cited

U.S. PATENT DOCUMENTS

| | | | |
|---|---|---|---|
| 4,186,982 | 2/1980 | Cobaugh et al. . | |
| 4,360,244 | 11/1982 | Forney, Jr. et al. . | |
| 4,506,939 | 3/1985 | Faulkenberry et al. | 439/63 |
| 4,511,197 | 4/1985 | Grabbe et al. . | |
| 4,513,353 | 4/1985 | Bakermans et al. . | |
| 4,605,269 | 8/1986 | Cohen et al. . | |
| 4,659,156 | 4/1987 | Johnescu et al. . | |
| 4,664,467 | 5/1987 | Tengler et al. | 439/581 |
| 4,684,184 | 8/1987 | Grabbe et al. . | |
| 4,684,200 | 8/1987 | Capp . | |
| 4,699,593 | 10/1987 | Grabbe et al. . | |
| 4,795,352 | 1/1989 | Capp et al. | 439/63 |

*Primary Examiner*—Joseph H. McGlynn
*Attorney, Agent, or Firm*—James M. Trygg

[57] ABSTRACT

A connector assembly (26) for use with a printed circuit board (30) wherein a true coaxial connection is provided. The connector assembly includes a housing block (36) with a plurality of bores (38) aligned with the plated-through apertures (42) of the circuit board. Each of the bores (38) contains a coaxial connector subassembly (50) which provides surface contact with the signal pads (46) and ground pads (48) surrounding the apertures (42).

11 Claims, 5 Drawing Sheets

MULTI-PORT COAXIAL CONNECTOR ASSEMBLY

BACKGROUND OF THE INVENTION

This invention relates to printed circuit board connectors and, more particularly, to an improved multi-port coaxial connector assembly for printed circuit boards.

With the ever increasing speed of computer circuitry, new problems are discovered. The increased speed comes about from a reduction of the size of the components, which results in faster signal rise times to produce more electromagnetic radiation from the signal carrying conductors. As the size of the components is reduced, they become more sensitive to noise and cross-talk. This interference problem has in the past been solved by surrounding the signal carrying pin connected to the printed circuit board by other pins. These other pins are connected to ground to provide a "return path" for radiated signals so as to provide shielding.

While theoretically effective, the aforedescribed traditional shielding method has proven to be uneconomical because four to eight pins may be used per signal to provide cross-talk and noise immunity. With today's improved semiconductor processing technology, the printed circuit boards are exceedingly crowded with the greatly increased number of channels of communication which are required. Accordingly, the line width of the conductors has been shrinking from the traditional 0.015 inch width down to 0.003 inch.

Reducing the conductor line width has an impact on both economics and reliability. This is so because as the conductor width shrinks, random pin holes in the copper foil which are typically of 0.001 inch dimension represent a larger percentage of the conductor width. Such a discontinuity is difficult to detect during the manufacturing process, and therefore it severely impacts the manufacturing yield. Accordingly, a compromise is reached for the line width that produces an acceptable yield. Since the desired channel density is increasing and is projected to go to 600 channels per inch, it is apparent that connections cannot be accomplished in a single layer with the previously mentioned line widths. Therefore, multiple layer boards are used.

The use of multiple layer boards has both economic and technical limitations. The economic limitation is the cost per square inch per layer and therefore the more layers, the higher the cost and the higher the economic impact of a defective layer which results in non-acceptability of a board. As far as the technical limitations are concerned, there is a limit to the ratio of hole diameter to board thickness which can be achieved. As the boards become thicker, the "Z" axis expansion reaches a magnitude which exceeds the elastic limit of the copper plating in the hole, and the copper plating ruptures. It therefore follows that better economy can be achieved with a smaller number of layers balanced against a practical line width which produces adequate yields.

It is conventional to make connections to signals which are positioned at different layers on a printed circuit board by means of a plated-through hole into which a component lead is inserted. The connection between such leads and the plated-through hole is achieved either by the traditional method of soldering or by mechanical interference it is taught, for example, by U.S. Pat. No. 4,186,982. Both of these methods require a minimal practical diameter of a hole and a wall thickness of the plating sufficient to conduct the current and withstand the "Z" axis expansion of the laminated board. In traditional computer back panel technology, holes with diameters ranging from 0.030 inch to 0.040 inch are used. Since the holes are positioned on some sort of a grid, typically on 0.100 inch centers, the space between two adjacent holes is the space available on a layer through which to run conductors. There has to be an insulation space between the conductor and the plated-through hole, as well as between adjacent conductors. With the above mentioned dimensions, the space occupied by the hole is large and means must therefore be found to minimize the territory occupied by the plated-through hole.

The obvious solution is to reduce the diameter of the hole. However, there are at least two limiting factors. A first factor is that the component lead will have to be similarly reduced, which makes it difficult to handle the components without damaging them. A second factor is that the alignment of component leads to the holes becomes extremely difficult and the economics become prohibitive. It is therefore a primary objective of this invention to reduce the hole diameter while obviating the described limiting factors.

SUMMARY OF THE INVENTION

The foregoing and additional objects are attained in accordance with the principles of this invention by providing a connector assembly wherein the purpose of the plated-through hole is limited to an electrical connection function between layers and bringing the signal to the surface of the board without the requirement of accepting a component lead. The hole diameter can then be as small as the drilling and plating technology permits, greatly increasing the space for running conductors on each layer. Accordingly, the present invention provides an assembly for reliably making connections to the surface of the board in appropriate locations. Moreover, the present invention provides a connection assembly of coaxial configuration for improved shielding, and for so called balance mode interconnection.

According to the present invention, there is provided a coaxial connector assembly for use with a printed circuit board, the printed circuit board having a dielectric substrate, a conductive signal pad on a first surface of the substrate, and a conductive ground pad on the first surface adjacent to and spaced from the signal pad. The connector assembly comprises a monolithic contact element, a dielectric support element, a conductive sleeve element, and a housing block. The monolithic contact element includes a support portion, an elongated signal pin portion extending from a first side of the support portion, and a spring contact portion extending from a second side of the support portion opposite the first side. The dielectric support element is adapted to secure therein the support portion of the contact element with the signal pin portion extending outwardly from a first end of the support element and the spring contact portion being exposed at a second end of the support element opposite the first end. The conductive sleeve element has a first portion and a second portion, the first sleeve portion surrounding the support element and the second sleeve portion surrounding the signal pin portion and including means for retaining the support element within the first sleeve portion. The housing block has a bore therethrough internally configured as complemental to the exterior of the sleeve element. There is further provided means for mounting the housing block to the substrate first surface so that, with the contact element, the support element and the sleeve element assembled and within the bore of the housing block, the spring contact portion of the contact element is in touching contact with the signal pad on the first surface of the printed circuit board substrate and the first sleeve portion of the sleeve element is in touching contact with the ground pad on the first surface of the printed circuit board substrate. In accordance with an aspect of this invention, the contact element is formed as a stamping from a flat sheet of material.

In accordance with another aspect of this invention, the signal pin portion of the contact element may have a circular cross-section.

In accordance with a further aspect of this invention, the spring contact portion of the contact element is formed as a mechanically compliant substantially closed loop contact to both provide compliance and stored energy and provide a low inductance signal path from the signal pad on the first surface of the printed circuit board substrate to the signal pin portion of the contact element.

In accordance with yet another aspect of this invention, the support portion of the contact element includes a pair of tab members extending from the support portion transverse to the signal pin portion and the support element is formed as a body with a cavity extending part way into its interior from the second end to allow entry of the contact element, the body being formed with an aperture communicating the first end with the cavity to allow exit of the signal pin portion of the contact element.

In accordance with still another aspect of this invention, the body is further formed with a slot extending into the body from the periphery thereof, the slot having a thickness commensurate with the width of one of the tab members, the slot being wedge-shaped with its apex at the central axis of the body, the slot intersecting the cavity where the one tab member is positioned to allow the one tab member to be bent within the slot out of the cavity so as to be trapped within the walls of the slot.

In accordance with yet a further aspect of this invention, the first sleeve portion of the sleeve element is formed with a plurality of angled cavities spaced about the periphery thereof, the cavities being open at the end of the sleeve element in contact with the ground pad on the first surface of the printed circuit board substrate to provide compliant stored energy contact points to the ground pad.

In accordance with yet another aspect of this invention, the second sleeve portion of the sleeve element is formed with a plurality of inwardly extending spring members.

In accordance with a further aspect of this invention, the circuit board has a plurality of spaced signal and ground pads, the housing block is formed with a plurality of bores spaced to be in alignment with the pads when the housing block is mounted to the substrate first surface by the mounting means, and the plurality of bores contains a plurality of assembled contact, support and sleeve elements.

In accordance with still a further aspect of this invention, the dielectric support element is formed as a cylindrical block.

In accordance with another aspect of this invention, the second sleeve portion is of reduced diameter relative to the first sleeve portion, the transition region between the first and second sleeve portions forming a shoulder abutting the first end of the support element so as to function as the retaining means.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
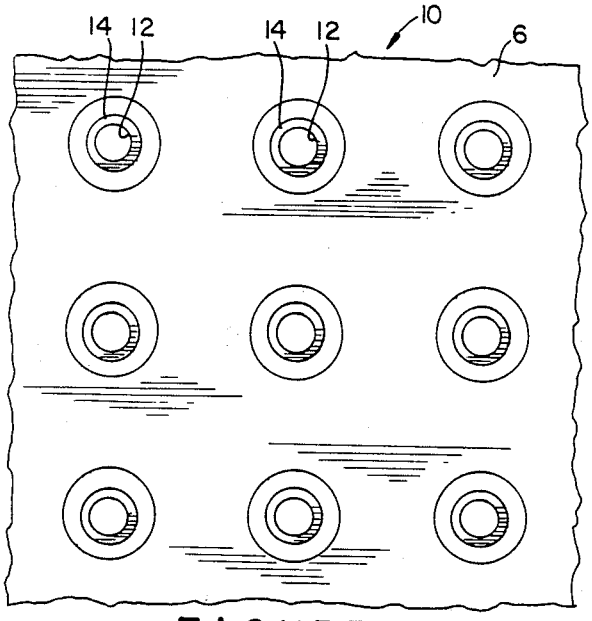
FIG. 1 illustrates a typical circuit board pattern using what is known as a common ground.

Referring to the drawings, FIG. 1 shows a surface of a printed circuit board 10 with a plurality of apertures 12 through the board 10. The apertures 12 are internally plated with conductive material and are surrounded by conductive signal pads 14 which are in electrical contact with the plating in the respective apertures 12. Surrounding and spaced from the signal pads 14 is a conductive ground pad 16. The printed circuit board shown in FIG. 1 illustrates a printing pattern known as a common ground, where the ground pad 16 is common to all of the apertures 12 and signal pads 14.

Figure 2:
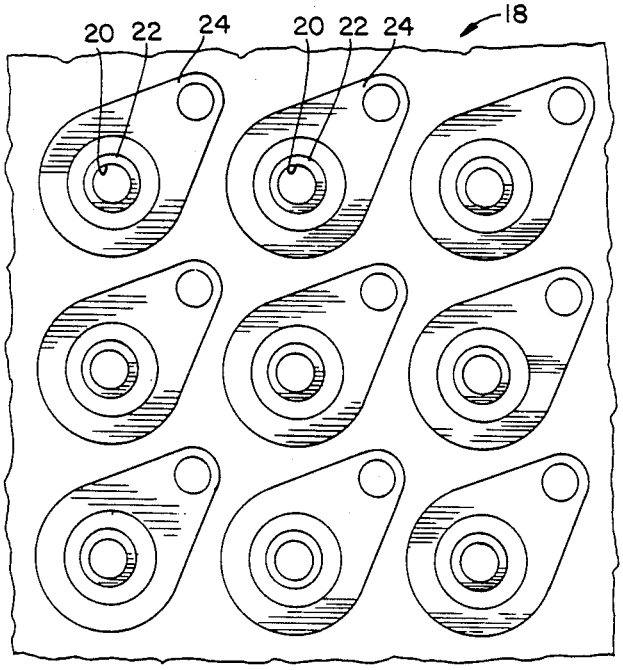
FIG. 2 illustrates a typical circuit board pattern for a true coaxial connection.

FIG. 2 shows a printed circuit board 18 with a conductive pattern for coaxial connections. Thus, there are a plurality of internally plated apertures 20 surrounded by signal pads 22 in electrical contact with the aperture plating. Surrounding and spaced from the signal pads 22 are a plurality of conductive ground pads 24, each individual to a respective one of the apertures 20 and signal pads 22. In any event, the inventive arrangement to be described hereinafter may work with either of the patterns of FIG. 1 or FIG. 2, and in both cases, the apertures 12 or 20 perform an electrical function only, and not a mechanical function as was conventional heretofore, since the inventive construction uses a surface mounting and connection technique. Further, the inventive arrangement may be applied to a printed circuit board without apertures.

Figure 3:
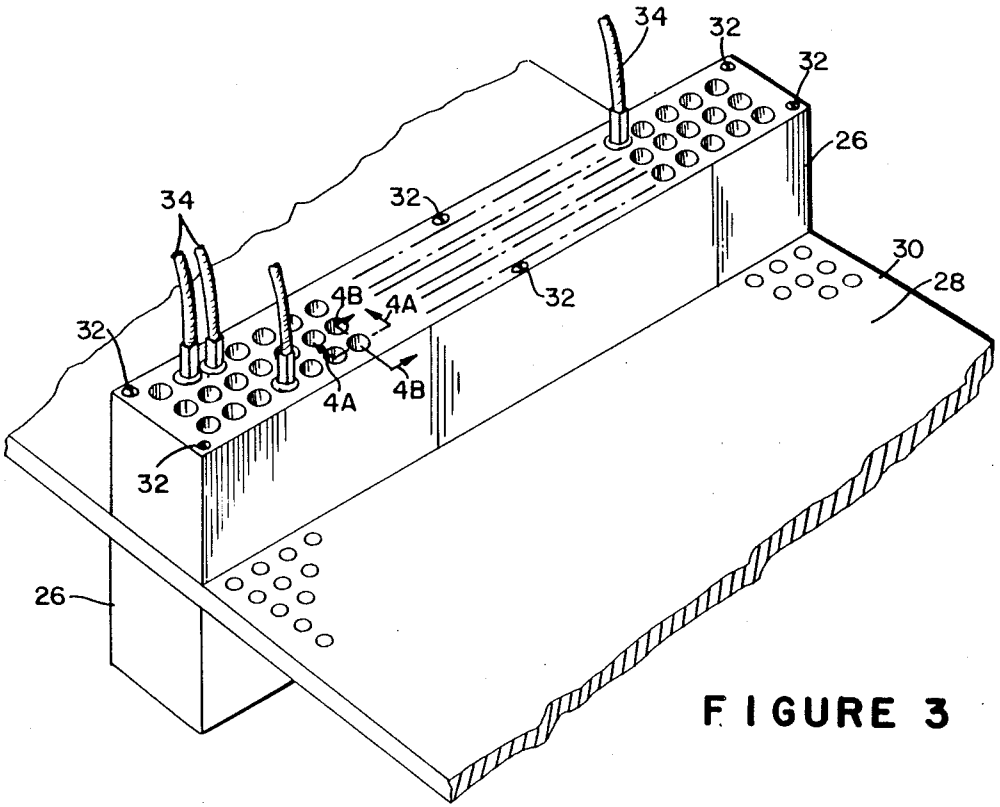
FIG. 3 is a perspective view of a circuit board showing a connector assembly according to this invention mounted thereon.

FIG. 3 illustrates the inventive coaxial connector assembly 26 mounted on a first surface 28 of a printed circuit board 30. Preferably, the circuit board 30 is sandwiched between two identical assemblies 26, one on each side of the circuit board 30, which are clamped against the circuit board 30 and held in position by screws 32 or the like. Since the total force of a large number of contacts may add up to a substantial magnitude, the board could eventually be deflected if there was an assembly 26 mounted on one side only, which would result in a loss of contact force and a loss of reliability. The inventive assembly is totally symmetrical with balanced forces acting on the board, generating compressive stress without bending moment, and thus will maintain the correct relationship between the contacts and the circuit board forever. As shown in FIG. 3, a plurality of wire terminations 34 are made to the printed circuit board 30 through the connector assembly 26.

Figure 4A:
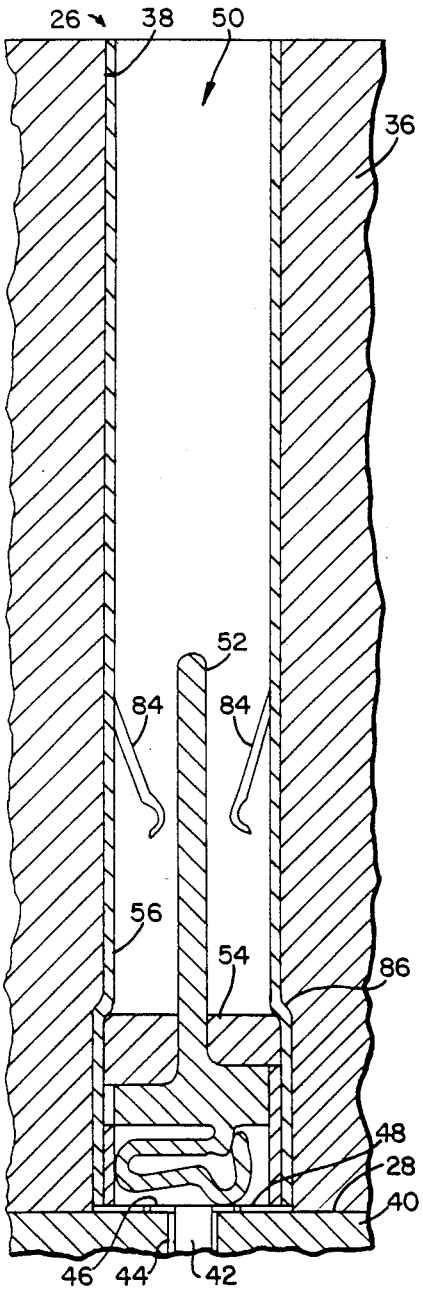
FIG. 4A is a partial cross-sectional view taken along the line 4A—4A in FIG. 3.
Figure 4B:
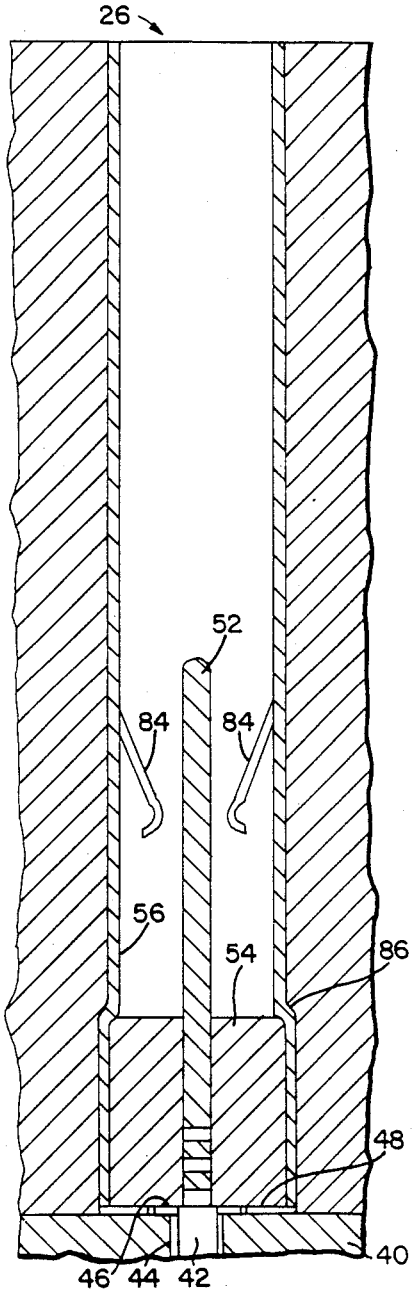
FIG. 4B is a partial cross-sectional view taken along the line 4B—4B in FIG. 3.

FIGS. 4A and 4B are orthogonally directed cross-sectional views through the connector assembly 26. Thus, the connector assembly 26 includes a housing block 36 having a bore 38 therethrough. The housing block 36 is mounted on the first surface 28 of the dielectric substrate 40 of the printed circuit board 30. The substrate 40 has an aperture 42 therethrough, with the aperture 42 having conductive plating 44 therein. Surrounding the aperture 42 and in electrical contact with the plating 44 is a signal pad 46 on the first surface 28. A ground pad 48 is also on the first surface 2 and is adjacent to the signal pad 46 while being spaced therefrom. The ground pad 48 may have the pattern shown in either of FIGS. 1 or 2, where the adjacency includes surrounding the signal pad 46.

Contained within the bore 38 is a male coaxial connector subassembly 50. The male connector subassembly 50 is made up of three parts. These are the contact element 52, the support element 54 and the sleeve element 56.

Figure 5:
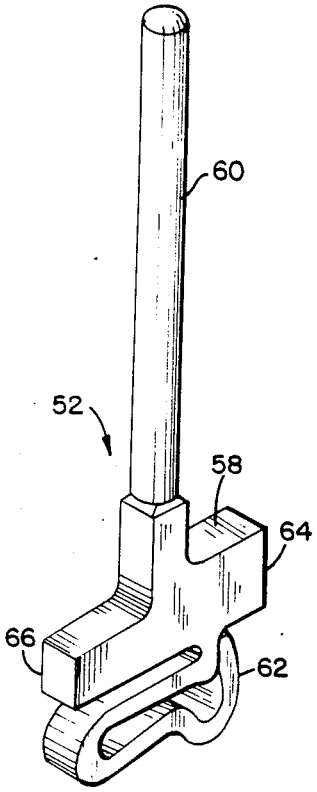
FIG. 5 is a perspective view of a contact element according to this invention.

FIG. 5 illustrates the contact element 52. The contact element 52 is of monolithic construction and is preferably formed as a stamping from a flat sheet of material. The contact element 52 includes a support portion 58, an elongated signal pin portion 60 extending from a first side of the support portion 58, and a spring contact portion 62 extending from a second side of the support portion 58 opposite the first side. The signal pin portion 60 preferably has a circular cross-section generated from the flat stamping by means of profiling, shaving, coining, burnishing and electroplating. The spring contact portion 62 is formed as a mechanically compliant substantially closed loop to provide compliance and stored energy as well as to provide a low inductance signal path for the signal current to flow from the signal pad 46 to the signal pin portion 60. Note from FIG. 4A that the spring contact portion 62 is in mechanical and electrical surface contact with the signal pad 46.

The contact support portion 58 includes a pair of tab members or lateral extensions 64 and 66 which extend transverse to the signal pin portion 60. The purpose of the tab member 64 is to provide a point for applying pressure during assembly of the contact element 52 into the support element 54. The tab member 64 also serves as a stop to limit the travel of the contact element 52 away from the circuit board 30 and keeps the spring contact portion 62 pre-loaded in the assembly. The function of the tab member 66 will become apparent from the description of the support element 54.

Figure 6B:
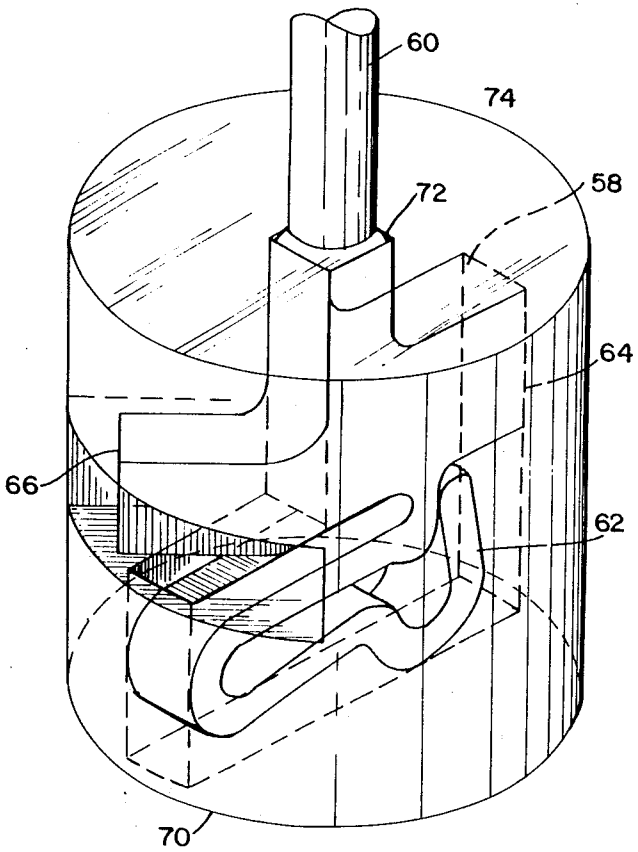
FIG. 6B is a perspective view of the dielectric support element of FIG. 6A with the contact element of FIG. 5 inserted therein.
Figure 6A:
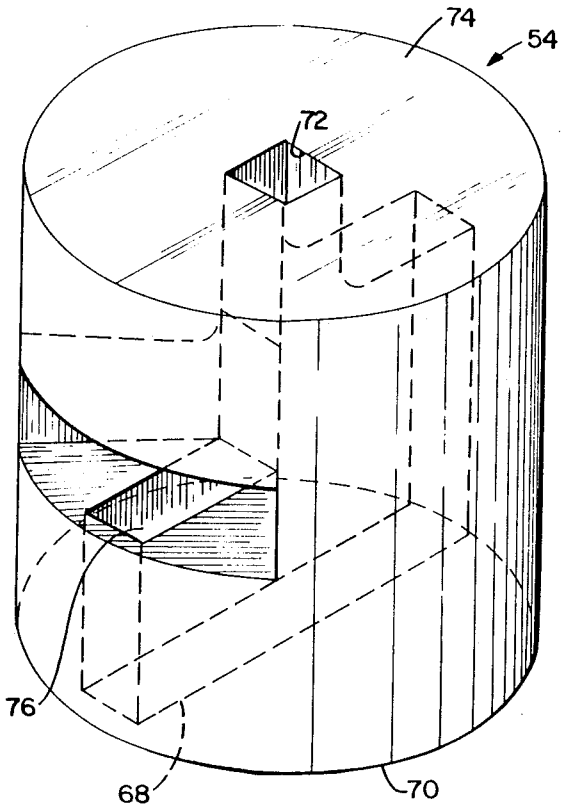
FIG. 6A is a perspective view of a dielectric support element in accordance with this invention.

As shown in FIG. 6A, the support element 54 is formed as a body of dielectric material, preferably in the form of a cylindrical block. A cavity 68 extends part way into the interior of the block from an end 70 thereof. The support element block 54 is further formed with an aperture, or bore, 72 extending from its other end 74 to communicate the end 74 with the cavity 68. The support element block 54 is further formed with a slot 76 which extends into the block from the periphery thereof. The slot 76 has a thickness commensurate with the height of the tab member 66 and is wedge-shaped with its apex substantially at the central axis of the support element block 54. As illustrated in FIG. 6B, the contact element 52 is inserted into the support element block 54 from the end 70 thereof. The signal pin portion 60 exits through the bore 72, while the contact support portion 58 and the spring contact portion 62 remain within the cavity 68. After insertion, the tab member 66 is bent within the slot 76 out of the cavity 68 so as to be entrapped within the walls of the slot 76. Thus, the contact element 52 is held by the support element 54 with the signal pin portion 60 extending outwardly from the end 74 and the spring contact portion 62 being exposed at the end 70.

Figure 7:
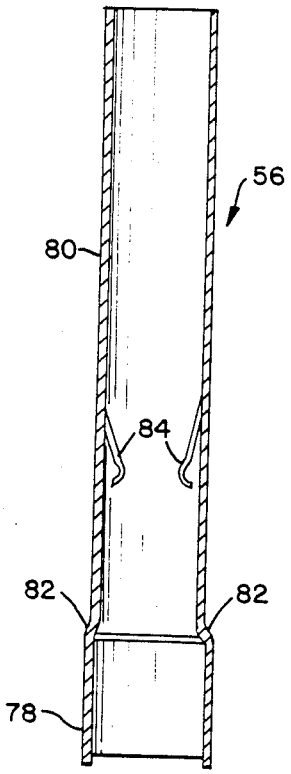
FIG. 7 is a cross-sectional view of a sleeve element according to this invention.
Figure 8:
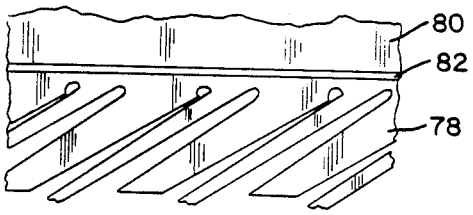
FIG. 8 is a detail of the first sleeve portion of the sleeve element of FIG. 7.
Figure 9:
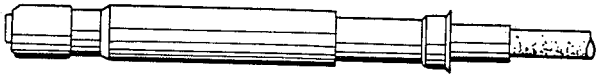
FIG. 9 shows a female termination of a conductor for use with the connector assembly of this invention.

FIGS. 7 and 8 show the sleeve element 56. As shown in FIG. 7, the sleeve element 56 includes a first portion 78 and a second portion 80. The first portion 78 of the sleeve element 56 surrounds the support element 54 and the second portion 80 surrounds the signal pin portion 60 of the contact element 2. The second portion 80 includes means for retaining the support element 54 within the first sleeve portion 78. The function of the retaining means is accomplished by forming the second portion 80 with reduced diameter relative to the first portion 78, so that the transition region 82 between the first portion 78 and the second portion 80 forms a shoulder which abuts the end 74 of the support element 54. The second sleeve portion 80 is formed with a plurality of inwardly extending spring members 84 which serve the dual purpose of mechanically retaining a female connector inserted in the sleeve element 56 and providing an electrical connection from the sleeve element 56 to the sleeve of the female connector. Such a female connector is illustrated generally in FIG. 9. FIG. 8 illustrates a detail of the first sleeve portion 78, which is formed with a plurality of angled cavities being open at the end which is in contact with the ground pad 48. These cavities define elements which provide compliant stored energy contact points to the ground pad 48.

To assemble the aforedescribed coaxial connector assembly, the contact element 52 is inserted into the support element 54 and the tab member 66 is bent, as hereinabove described. These elements are then inserted into the sleeve element 56 until the end 74 of the support element 54 abuts the shoulder 82. This subassembly 50 is then inserted into the bore 38 of the block 36. The bore 38 is formed complemental to the sleeve element 56 with a shoulder 86 which abuts the shoulder 82 to apply pressure to the sleeve element 56 so that the first sleeve portion 78 makes contact with the ground pad 48. Pressure is also applied in this manner through the sleeve element 56 and through the support element 54 to the spring contact portion 62 of the contact element 58 to maintain contact with the signal pad 46.

Preferably, the block 36 contains a plurality of bores 38, each of which contains a complete subassembly 50 of sleeve element 56, support element 54, and contact element 52. The bores are spaced to be in alignment with the apertures 42 on the circuit board when the housing block 36 is mounted on the circuit board. After such mounting, the connector assembly makes electrical connection with the signal pads and ground pads surrounding the apertures. It is to be noted that these connections are surface connections, so the apertures only have an electrical function and not a mechanical function. Accordingly, the previously described limitations on the apertures are avoided.

There has thus been described an improved coaxial connector assembly for use with a printed circuit board. While a preferred embodiment has been disclosed, it will be apparent to one of ordinary skill in the art that various modifications and adaptations to the disclosed arrangement can be made, without departing from the spirit and scope of this invention, which is only intended to be limited by the appended claims.

I claim:

1. A coaxial connector assembly (26) for use with a printed circuit board (30), said printed circuit board (30) having a dielectric substrate (40), a conductive signal pad (46) on a first surface (28) of said substrate, and a conductive ground pad (48) on said first surface (28) adjacent to and spaced from said signal pad (46), said connector assembly (26) comprising:

a monolithic contact element (52) including a support portion (58), an elongated signal pin portion (60) extending from a first side of said support portion (58), and a spring contact portion (62) extending from a second side of said support portion (58) opposite said first side;

a dielectric support element (54) adapted to secure therein said support portion (58) of said contact element (52) with said signal pin portion (60) extending outwardly from a first end (74) of said support element (54) and said spring contact portion (62) being exposed at a second end (70) of said support element (54) opposite said first end (74);

a conductive sleeve element (56) having a first portion (78) and a second portion (80), said first sleeve portion (78) surrounding said support element (54) and said second sleeve portion (80) surrounding said signal pin portion (60) and including means for retaining said support element (54) within said first sleeve portion (78);

a housing block (36) having a bore (38) therethrough internally configured as complemental to the exterior of said sleeve element (56); and means (32) for mounting said housing block (36) to said substrate first surface (28) so that with said contact element (52), said support element (54) and said sleeve element (56) assembled and within said bore (38), said spring contact portion (62) is in touching contact with said signal pad (46) and said first sleeve portion (78) is in touching contact with said ground pad (48).

2. The assembly according to claim 1 wherein said contact element (52) is formed as a stamping from a flat sheet of material.

3. The assembly according to claim 1 wherein said signal pin portion (60) has a circular cross-section.

4. The assembly according to claim 1 wherein said spring contact portion (62) is formed as a mechanically compliant substantially closed loop contact to both provide compliance and stored energy and provide a low inductance signal path from said signal pad (46) to said signal pin portion (60).

5. The assembly according to claim wherein: said support portion (58) includes a pair of tab members (64, (66) extending from said support portion (58) transverse to said signal pin portion (60); and said support element (54) is formed as a body with a cavity (68) extending part way into its interior from said second end (70) to allow entry of said contact element (52), said body being formed with an aperture (72) communicating said first end (74) with said cavity (68) to allow exit of said signal pin portion (60).

6. The assembly according to claim 5 wherein said body is further formed with a slot (76) extending into said body from the periphery thereof, said slot (76) having a thickness commensurate with the width of one of said tab members (66), said slot (76) being wedge-shaped with its apex at the central axis of said body, said slot (76) intersecting said cavity (68) where said one tab member (66) is positioned to allow said one tab member (66) to be bent within said slot (76) out of said cavity (68) so as to be entrapped within the walls of said slot (76).

7. The assembly according to claim 1 wherein said first sleeve portion (78) is formed with a plurality of angled cavities spaced about the periphery thereof, said cavities being open at the end of said sleeve element in contact with said ground pad (48) to provide compliant stored energy contact points to said ground pad (48).

8. The assembly according to claim 1 wherein said second sleeve portion (80) is formed with a plurality of inwardly extending spring members (84).

9. The assembly according to claim 1 wherein said circuit board (30) has a plurality of spaced signal pads (46) and ground pads (48), said housing block (36) is formed with a plurality of bores (38) spaced to be in alignment with said pads (46,48) when said housing block (36) is mounted to said substrate first surface by said mounting means (32), and said plurality of bores (38) contains a plurality of assembled contact (52), support (54) and sleeve (56) elements.

10. The assembly according to claim 1 wherein said dielectric support element (54) is formed as a cylindrical block.

11. The assembly according to claim 1 wherein said second sleeve portion (80) is of reduced diameter relative to said first sleeve portion (78), the transition region (82) of said sleeve element (56) between said first (78) and second (80) sleeve portions forming a shoulder abutting said first end (74) of said support element (54) so as to function as said retaining means.

* * * * *